US006131335A

United States Patent [19]

Lutz

[11] Patent Number: 6,131,335

[45] Date of Patent: Oct. 17, 2000

[54] DEVICE FOR OPERATING BLINDS WITH ASSISTED FORCE

[76] Inventor: Roland Lutz, 35 rue Lafayette, 38100 Mulhouse, France

[21] Appl. No.: 08/958,713

[22] Filed: Nov. 17, 1997

[30] Foreign Application Priority Data

Nov. 15, 1996 [FR] France ..... 96 14115

[51] Int. Cl.[7] ..... E06B 7/08

[52] U.S. Cl. ..... 49/74.1; 49/80.1; 49/87.1

[58] Field of Search ..... 49/73, 74.1, 80.1, 49/87.1, 89.1, 90.1, 371, 386, 387

[56] References Cited

U.S. PATENT DOCUMENTS

| | | | |
|---|---|---|---|
| 1,960,763 | 5/1934 | Waddell et al. | 49/87.1 |
| 2,479,602 | 8/1949 | Carani . | |
| 2,699,579 | 1/1955 | Jones . | |
| 3,954,023 | 5/1976 | Perez-Aguilar | 49/87.1 X |
| 4,268,995 | 5/1981 | Villa | 49/87.1 |
| 4,850,138 | 7/1989 | Watanabe et al. . | |
| 5,560,147 | 10/1996 | Ashida et al. | 49/74.1 |

FOREIGN PATENT DOCUMENTS

| | | |
|---|---|---|
| 490853 | 10/1976 | Austria . |
| 40722 | 4/1980 | Austria . |
| 520143 | 1/1982 | Austria . |
| 0 399 130 | 11/1990 | European Pat. Off. . |
| 90 17 185 | 3/1991 | Germany . |
| WO 95/02109 | 1/1995 | WIPO . |

*Primary Examiner*—Jerry Redman
*Attorney, Agent, or Firm*—Young & Thompson

[57] ABSTRACT

A device for operating blinds includes a centralized control device 92) for the blinds and an actuator (3) for actuating the control device that are in a casing (4) fixed in or on an upright (5) of the window. The actuator (3) for the blinds includes a rod (6) connecting the centralized control device (2) to individual levers (7) that are each secured to a pivotal axle (8) of a slat of the blinds. The actuator (3) for the blinds is provided with a device (10) for compensation of the weight of the slats.

10 Claims, 7 Drawing Sheets

DEVICE FOR OPERATING BLINDS WITH ASSISTED FORCE

BACKGROUND OF THE INVENTION

The present invention relates to the field of construction, in particular the closing of glazed openings by means of windows with blinds, and has for its object a device for operating blinds with assisted force.

Windows with blinds are windows provided with parallel slats, transparent or not, overlapping along their longitudinal edges and mounted at their ends pivotably about a horizontal axis, these slats or blinds being actuated individually or group-wise by means of a corresponding operating device, with a lever, conical gears or with a wheel and endless screw, so as to permit adjustment of the circulation of air and/or the penetration of light.

At present, the operation of blinds generally takes place by means of devices with a lever, conical gears or with a wheel and endless screw, or else by means of small chains mounted on said slats, etc. . . . Such devices offer effective and reliable operating solutions. However, these devices are of the direct force transmission type, such that they require a large expenditure of energy for operating the pivotal slats mounted in overhanging relationship. This force becomes greater as the number of slats increases.

The pivotal mounting of blinds generally is carried out by means of a device coacting with the ends of the slats forming the blinds and consisting in a gripping portion of each end of the slats associated with pivoting means in a corresponding bearing or by means of an actuating element for pivoting said slat.

Generally, the gripping portion of each end of the slats is constituted by a reception and holding member for the end of the slat, extending on opposite sides of the latter, over all or a portion of the surface and as the case may be gripping it. This gripping portion of each end is connected by its pivoting means in the corresponding bearing by being made of one piece with this latter or by an assembly which is disassemblable or not, and the pivoting actuating element for the slat is in the form of a lever secured to one of the gripping portions at one end.

These mounting devices pivoting the blinds of course permit a certain correct operation of these latter; however, they generally offer no flexibility of adaptation, for example two different operating means, particularly by modification of the connection between the gripping portion of the end of the slat coacting with the actuating element for corresponding pivoting, for example in the form of a lever. This has the result of a modification of the mounting of the blinds, perhaps with the use for example of a change of the arrangement of the actuating means, and hence of the position of the connection of this latter to the pivoting actuating member, which is impossible without supplemental fitting operations, the lever forming the pivoting actuating element being indexed in a fixed manner.

SUMMARY OF THE INVENTION

The present invention has for its object to overcome these drawbacks by providing an operating device for blinds with assisted force permitting easy operation of the blinds no matter what their number or size, as well as easy adaptation of the blinds to different operating devices by modification of the assembly of its constituent elements.

According to the invention, the device for operating blinds, which comprises a central control means for the blinds and an actuation means of these latter, these means being disposed in a casing fixed in or on an upright of the window with blinds, is characterized in that the actuating means for the blinds is provided with a device for compensating the weight of the blades constituting the blinds.

BRIEF DESCRIPTION OF THE DRAWINGS

The invention will be better understood from the following description, which relates to preferred embodiments, given by way of non-limiting examples, and explained with reference to the accompanying schematic drawings, in which.

DESCRIPTION OF THE PREFERRED EMBODIMENT

Figure 1:
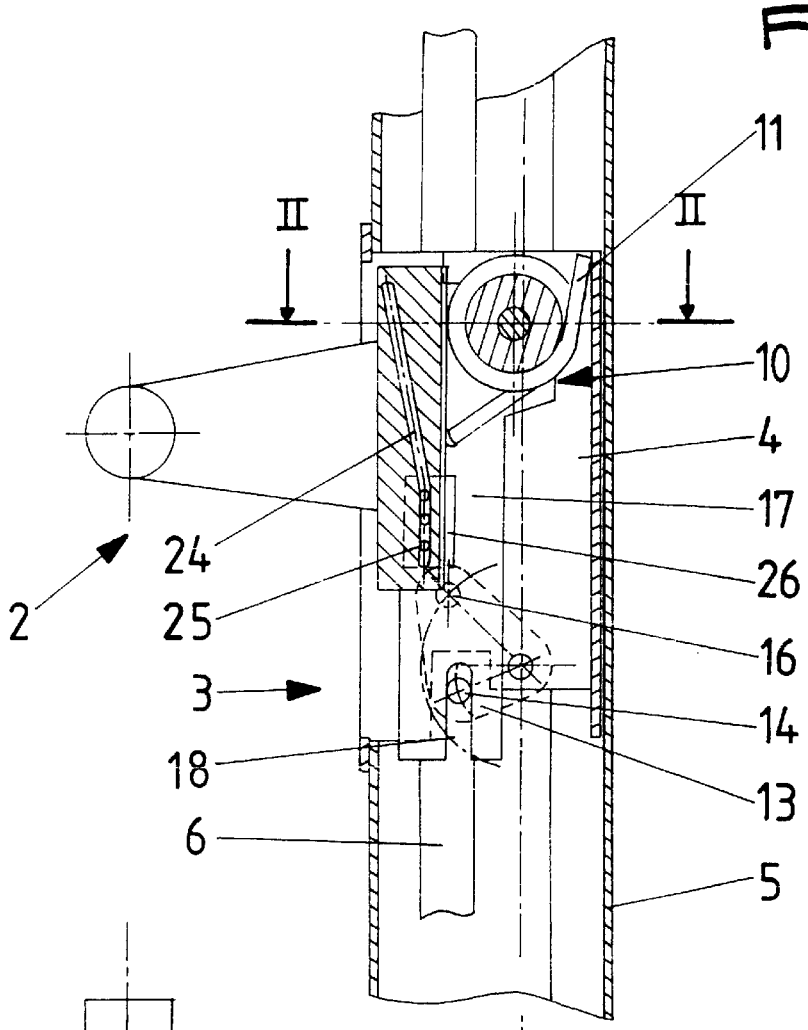
FIG. 1 is a side elevational and cross-sectional view of the device according to the invention.
Figure 2:
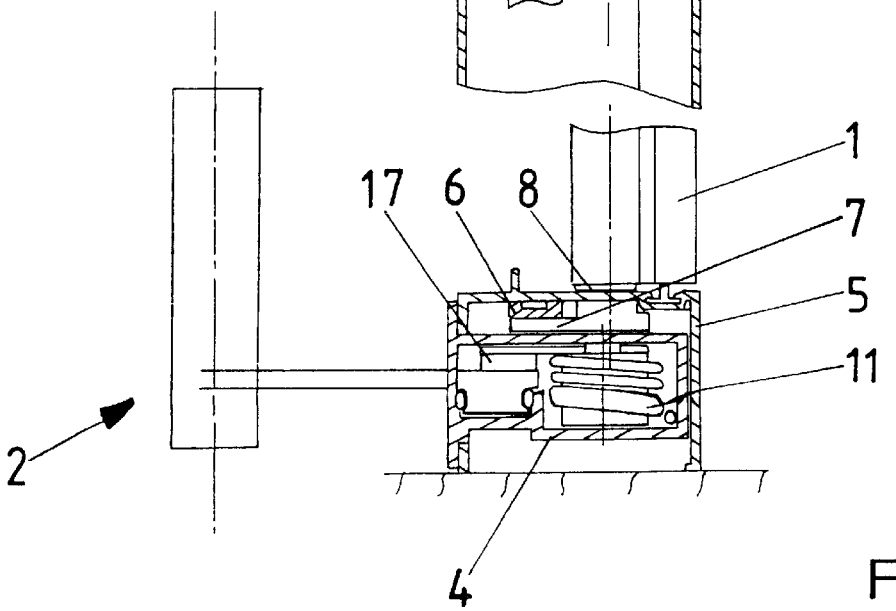
FIG. 2 is a cross-sectional view on the line II—II of FIG. 1.

FIGS. 1 and 2 of the accompanying drawings show by way of example a device for operating blinds 1, which comprises a centralized control means 2 of the blinds 1 and an actuating means 3 for these latter. These means 2 and 3 are disposed in a casing 4 fixed in or on an upright 5 of the window with blinds. In the embodiment shown in FIGS. 1 to 3, as well as that of FIGS. 4 to 6, the casing 4 is fixed in the upright 5; however, it could also be fixed on said upright 5 or spaced therefrom, particularly for remote control, as a function of the technical and/or aesthetic needs. The means 3 for actuating the slats constituting the blinds 1 is constituted in a known manner by a rod 6 connecting the centralized control means 2 to individual levers 7 each secured to a pivoting axle 8 of a slat of a blind 1.

According to the invention, the actuating means 3 for the blinds 1 is provided with a device 10 for the compensation of the weight of the slats constituting the blinds 1. Thus, the manipulating forces for said slats of the blinds can be limited only to the force necessary to overcome friction, such that the control means used can be of very direct action, which is to say without a supplemental device for force demultiplication.

Figure 4:
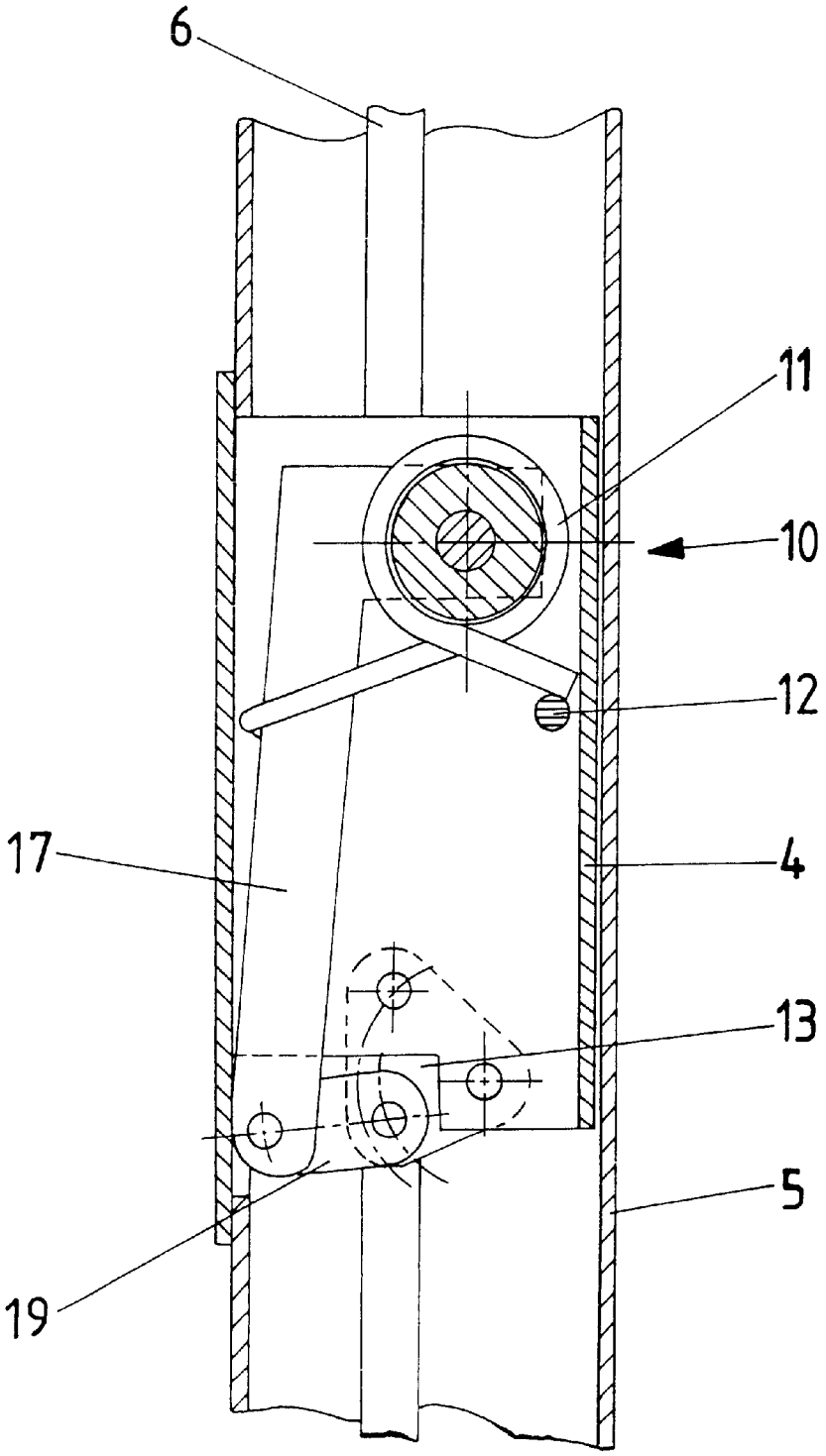
FIGS. 4 to 6 are views similar to that of FIG. 1, showing other embodiments of the device.
Figure 5:
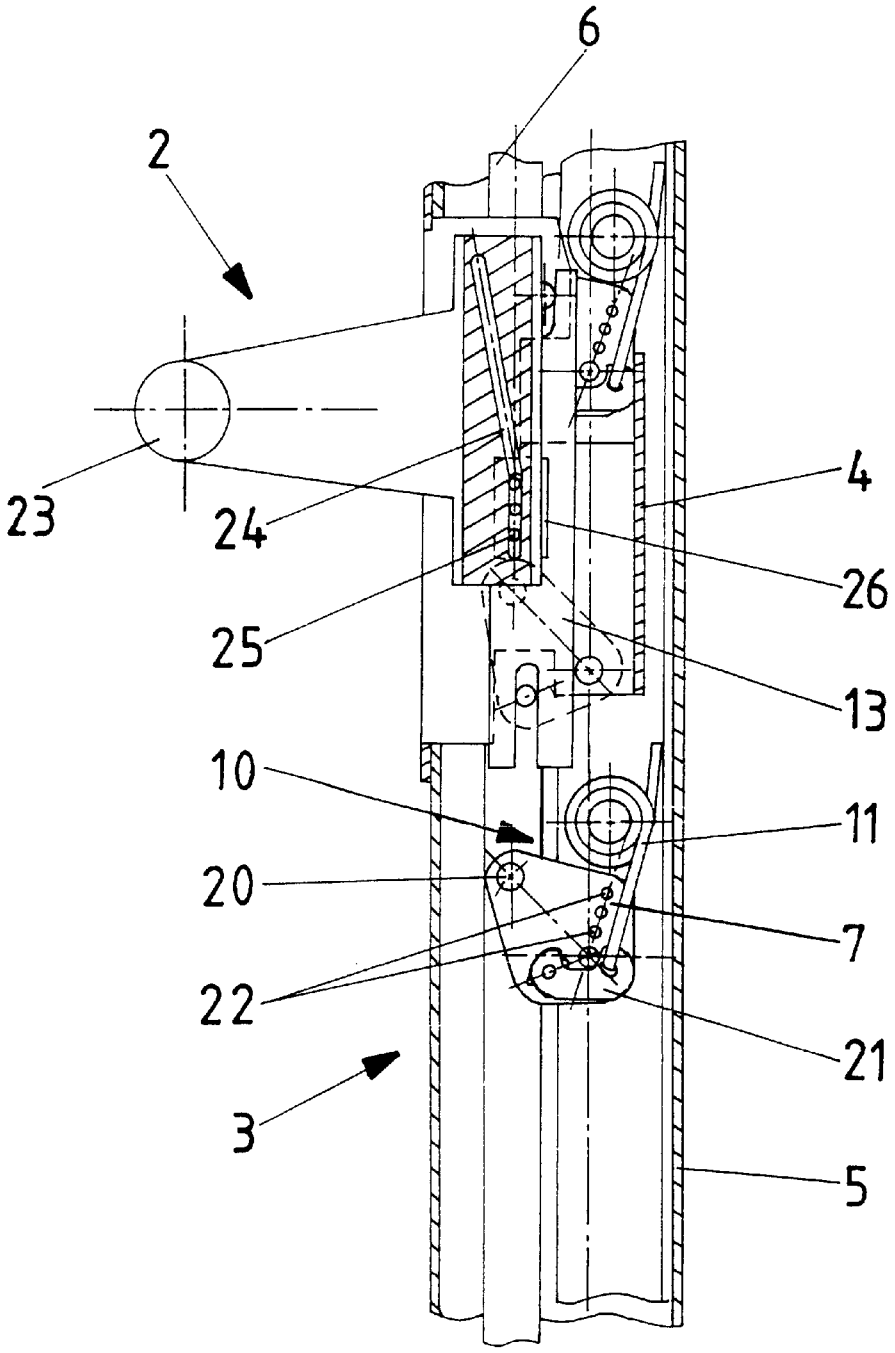
Figures 6, 7:
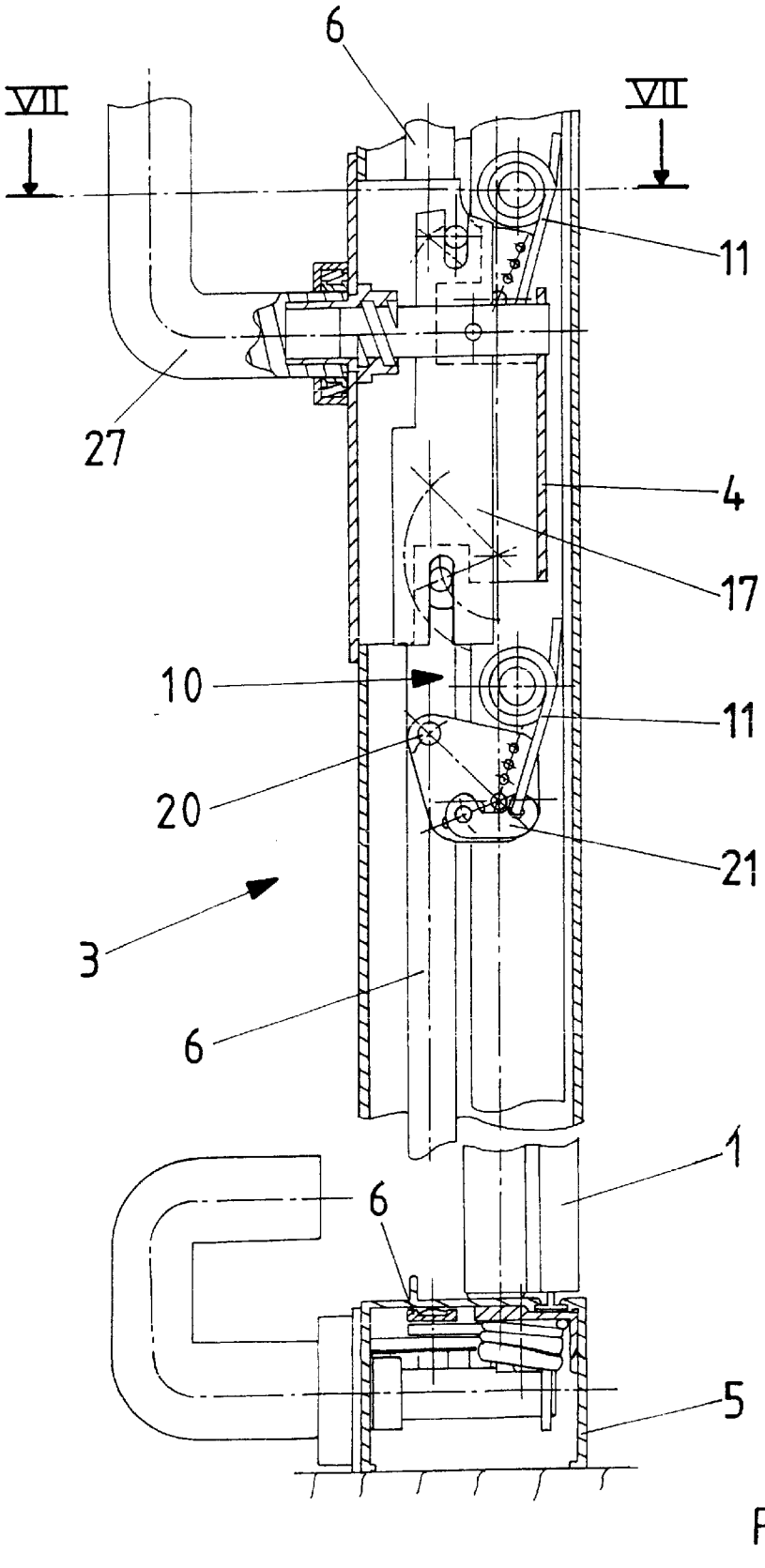
FIG. 7 is a cross-sectional view on the line VII—VII of FIG. 6.

This device 10 for compensating the weight of the slats constituting the blinds 1 can be either in the form of a centralized device integrated to the actuating means 3 for the blinds 1 (FIGS. 1 to 4), or in the form of a decentralized device acting on each slat of the blind 1 (FIGS. 5 and 6).

The device 10 is preferably constituted by a resilient prestressed means 11 acting on a force transfer means and is actuated by the centralized control means 2, either directly, in the case of an embodiment in the form of a centralized compensation device (FIGS. 1 to 4), or by means of the rod 6 of the actuating means 3 of the blinds 1, in the case of an embodiment in the form of a decentralized compensation device (FIGS. 5 and 6).

The prestressed resilient means 11 is preferably constituted by a fixed spring, in the casing 4 enclosing the centralized control means 2, in the case of an embodiment in the form of a centralized compensation device, or directly in the upright 5 of the window, one of the ends of this spring bearing on an abutment 12 of the casing 4 or against the corresponding surface of the upright 5, in the case of an embodiment in the form of a decentralized compensation device, whilst the other end acts on the force transfer means. Thus, the means 11 balances the couple exerted in each position of the slats of the blind 1.

According to one characteristic of the invention, the spring constituting the prestressed resilient means 11 has a load corresponding to the balancing couple to be exerted, respectively to maintain the slats of the blind 1 in all equilibrium positions, in the case of an embodiment in the form of a centralized compensation device, or to maintain individually each slat of the blind 1 in its different positions of opening, in the case of an embodiment in the form of a decentralized compensation device, the force of opening or closing movement being supplied by the centralized control means 2, such that the control of the slats of the blind 1 is of the non-return type ensuring their blocking in all positions. Thus, one actuation of the slats of the blind 1, by means of the means 2, requires only exerting on this means 2 a force corresponding to that corresponding to the frictional force in the different bearings.

According to a first embodiment of the invention, corresponding to that with centralized control, the force transfer means is in the form of an eccentric actuating plate 13, guided pivotally in the casing 4, provided with a drive lug 14 and articulated on the rod 6 by means of an axle 16. In this embodiment, the spring constituting the prestressed resilient means 11 acts on the force transfer means constituted by the eccentric operating plate 13, by means of a control lever 17 coacting at its free end with the force transfer means by means of the drive lug 14 secured to the operating plate 13 and guided in a guide slot 18 of the lever 17. Thus, during pivoting to the left of the lever 17, the eccentric operating plate 13 forming the force transfer means is driven pivotally about its axis of articulation in the casing 4, such that the rod 6 is displaced downwardly and to the right, which corresponds to the path of the drive lug 20 of the arm 7, according to FIGS. 1 and 4, in the direction of opening the slats of the blind 1.

FIG. 4 of the accompanying drawings shows a modified embodiment of the device for compensating the actuating means 3 for the slats forming the blinds 1, in which the force transfer means, constituted by the eccentric operating plate 13, is connected with articulation to the control lever 17 by means of a link 19. In such a case, pivoting of the lever 17 will result in substantially linear displacement of the link 19, effecting corresponding pivoting of the plate and a displacement in the same direction of the rod 6.

FIGS. 5 and 6 of the accompanying drawings show two modified embodiments of the invention, in which the device 10 for compensation of the weight of the slats constituting the blinds 1 is decentralized and is constituted, for each blind 1, by prestressed resilient means 11, in the form of a spring, and by a lever 7, secured to the pivotal axle 8 corresponding to the slat of the blind 1, articulated by a drive lug 20 on the rod 6 and articulatedly connected to the spring forming the prestressed resilient means 11 by means of a connection link 21.

According to one characteristic of the invention, the lever 7, secured to the pivotal axle 8 of the slat of the blind 1, is provided with several holes 22 adapted to coact with a lug secured to the corresponding end of the connecting link 21, these holes 21 extending radially from the pivotal axle 8 of the slat of the blind 1 and in an offset manner relative to a straight line connecting the pivotal axle 8 to the drive lug 20 of the lever 7. Thus, it is possible to bring about the adjustment of the couple exerted by the link 21 on the lever 7 and hence on the axle 8, as a function of the force necessary to ensure the maintenance and position of the slats of the blind 1 and which takes account of the weight of these latter.

During operation of the centralized control means 2 of the slats of the blind 1, for example in the direction of displacement of the rod 6 downwardly, each lever 7 is driven pivotally about the axle 8 of the blind 1 and the traction exerted by the spring forming the prestressed resilient means 11 on the link 21 and on the lever 7 brings about a lifting couple for the slat of the corresponding blind, actuation of the means 2 requiring simply the application of a force corresponding to the frictional forces in the different mechanisms. During actuation in the closing direction, the force necessary for operating the means 2 is identical, the couple developed by the spring then serving to ensure only a maintenance of the slat of the blind and avoiding any abrupt movement due to the weight of this latter.

Of course, in the case of operation with centralized compensation, the prestressed resilient means 11 works the same way.

According to another characteristic of the invention, the centralized control means 2 of the slats of the blind 1 is preferably constituted by a sliding handle 23 guided in the casing 4 and acting on the control lever 17 coacting with the means 3 for actuating the slats of the blind 1 by means of a cam 24 coacting with at least one roller 25 of a pivot plate 26 articulated on said lever 17 (FIG. 1). Thus, a vertical displacement of the handle 23 gives rise to a corresponding displacement of the pivot plate 26 and of the lever 17 along the curve of the cam 24, such that device 10 for compensation of the weight of the slats constituting the blind 1 will be actuated and the rod 6 will be displaced in the corresponding direction. A rectilinear profile of the cam 24 at the end of the path of movement ensures blocking of the slats forming the blinds 1 in closed and open positions.

Figure 3:
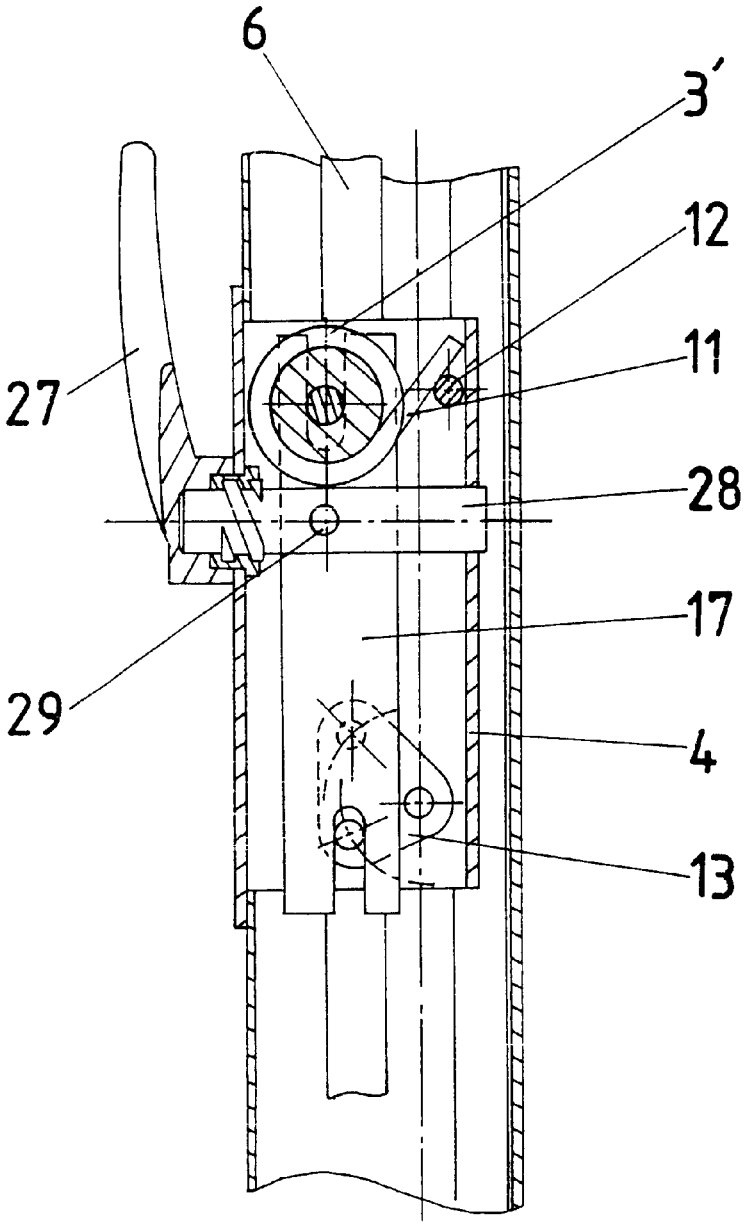
FIG. 3 is a cross-sectional view of a modified embodiment of the compensation device of the actuating means for the slats according to FIG. 1.

FIG. 3 of the accompanying drawings shows another modified embodiment of the invention, in which the means 2 for centralized control of the slats of the blind 1 is in the form of a turnable handle 27, guided on the casing 4 and coacting with an operating axle 28 by means of a screw and nut connection, this actuating axle 28 being connected articulatedly with the lever 17 by means of a drive plug 29, the lever 17 being connected with its articulation in the casing 4 by a guide slot 3'. The operation of the turnable handle 27 drives in linear displacement the operating axle 28 and causes a corresponding pivoting of the lever 17, simultaneously wit the actuation of the device 10 for compensating the weight of the slats constituting the blinds 1.

FIGS. 5 and 6 show the use of slidable handle 23 and turnable handle 27 to the embodiments of the device concerning the application of a decentralized compensation. In these embodiments, the construction of the means 2 remains identical to that described above.

According to another modified embodiment of the invention, not shown in the accompanying drawings, the centralized control means 2 for the slats of the blind 1 can also be constituted by a chain acting directly or indirectly on the control lever 17, this chain being guided, leaving the casing 4 and/or the upright 7 by return rollers or the like, in the case of indirect actuation of the control lever 17, the latter can be carried out for example by means of a cam, an eccentric lever or the like.

According to another modified embodiment of the invention, not shown in the accompanying drawings, the centralized control means 2 for the slats of the blind 1 can also be constituted by a motor, either whose output shaft engages with a pinion coacting with the rod 6 for connecting the individual levers 7 each secured to a pivotal axle 8 of a slat of a blind 1, this rod 6 being provided with a corresponding rack, or whose output shaft is provided with a cam or an actuating link for the control lever 17. Because of the compensation of the weight of the slats of the blind 1, an operating motor of low power can be used, only the mechanical resistance of friction being necessary to overcome.

According to another characteristic of the invention, the centralized control means of the slats of the blind 1 can be provided with a device for connecting in parallel two means 3 for actuating the slats constituting the blinds 1 of adjacent windows with blinds, from a single casing 4, this device (not shown) being for example in the form of interconnecting cross pieces secured to the rods 6 of each window and passing through corresponding uprights through slots provided in these latter, or directly axle to axle of at least one blind. This embodiment is also rendered possible by the provision of compensation for the weight of the slats.

It is also possible, according to another modified embodiment of the invention, not shown in the accompanying drawings, to provide the centralized control means 2 for the slats of the blind 1 in the form of two or more controls, which each element is associated on the one hand with the window with blinds and acts independently on the slats of the corresponding blind. Thus, a portion of the slats could for example be open, whilst another will be closed or simply half open.

Finally, the control means 2 can also be constituted by a crank (not shown) acting on the operating axle 28 connected to the lever 17 or directly to the lever 17. Such a means 2 in the form of a crank permits for example an actuation of the blinds in the closing or opening direction by a small rotation of the crank, namely a quarter turn or a half turn.

According to another characteristic of the invention, and as shown more particularly in FIGS. 8 to 11 of the accompanying drawings, the connection of each individual lever 7 to the pivotal axle 8 of a slat of blind 1 is effected by means of a mounting device, which comprises bearing means 30 each disposed in one end of a longitudinal recess 30' of a frame 31 for reception of the slat of the blind 1, and a means 32 for securement of each lever 7 with the c or responding bearing means 30. The bearing means 30 are present in a known manner in the form of members which are expansible or not, mounted in the corresponding ends of the frame 31 for reception of the slat of blind 1 and fixed in these latter by cementing, by force fitting or by expansion under the force of a mounting screw or the like forming the securement means 32.

Figure 8:
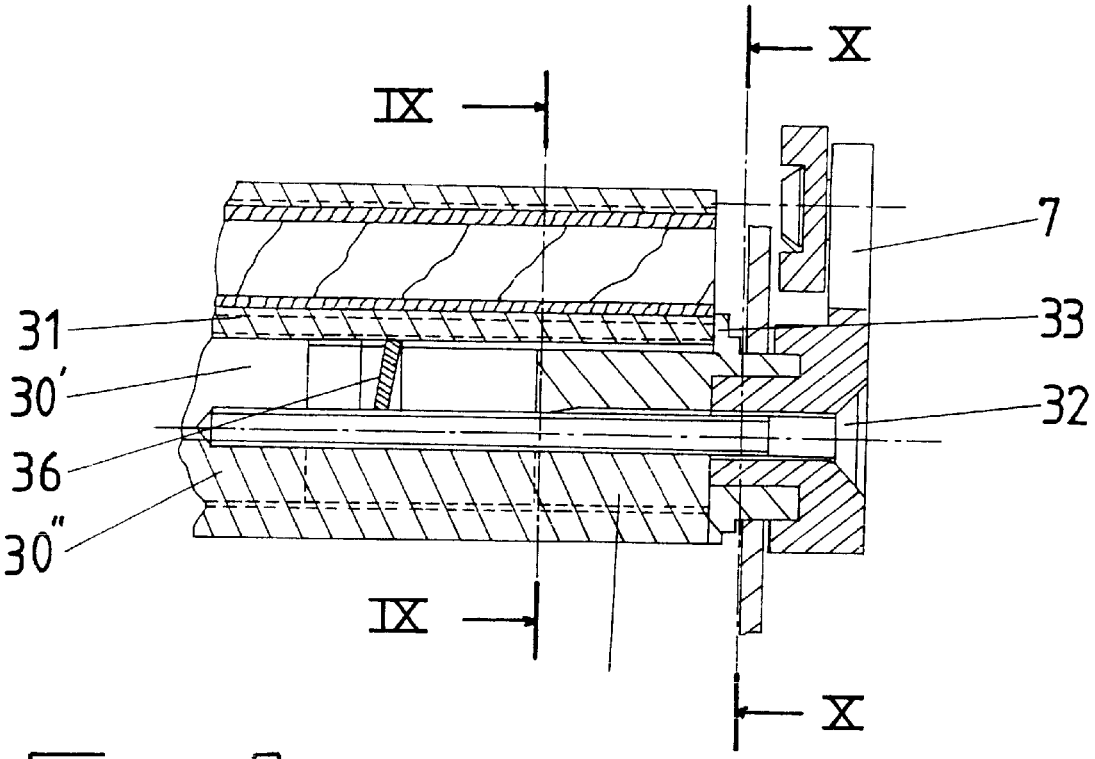
FIG. 8 is a fragmentary plan and cross-sectional view of a mounting device pivoting the blind.
Figure 11:
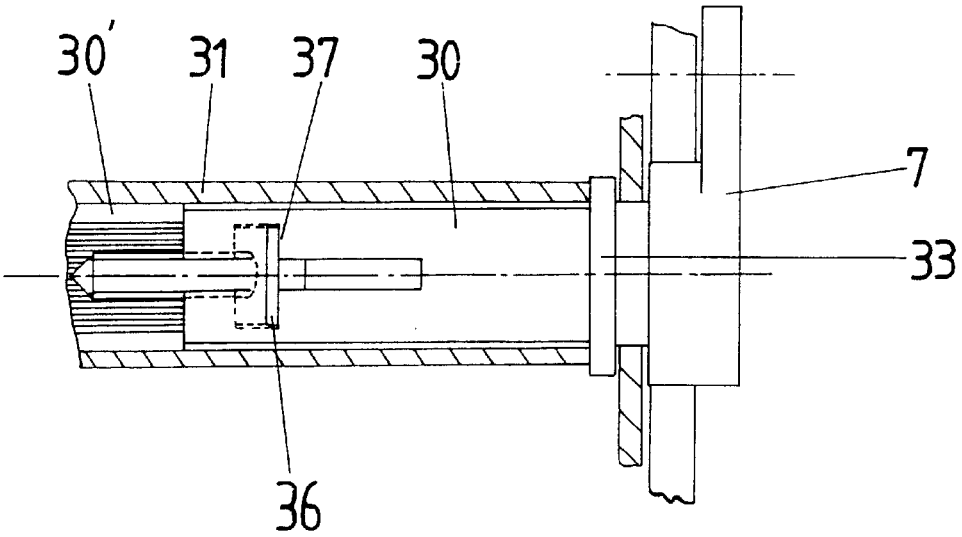
FIG. 11 is a fragmentary cross-sectional view on the line XI—XI of FIG. 9.
Figure 10:
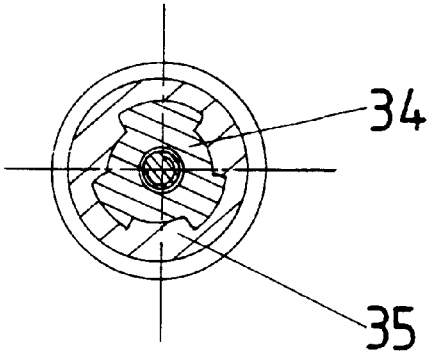
FIG. 10 is a cross-sectional view on the line X—X of FIG. 8.

According to the invention, each bearing means 30 is provided in a prolongation of its portion penetrating the end of the recess 30', with a bearing shoulder 33 on the corresponding end of the frame 31, this shoulder 33 being prolonged by a hollow indexing device 35 adapted to coact with corresponding means 34 of the lever 7 (FIGS. 8 and 10). Thus, it is possible to effect a precise and rapid positioning of the lever 7 relative to the slat of the blind 1, with perfect reproducibility from one slat to the other.

Preferably, this hollow indexing device 35 and the means 34 are present respectively in the form of a hole and a channeled hub.

Figure 9:
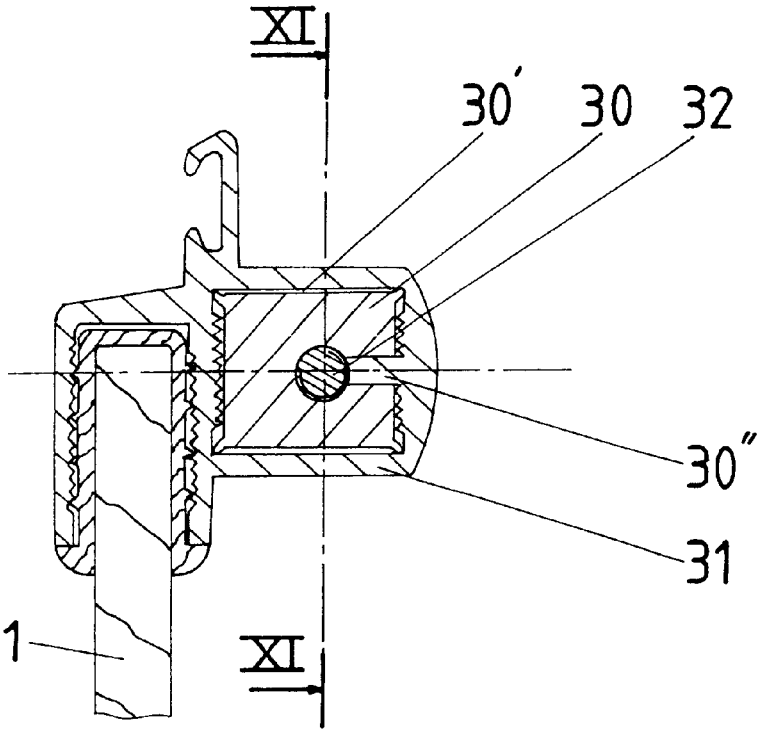
FIG. 9 is a cross-sectional view on the line IX—IX of FIG. 8.

According to another characteristic of the invention, the recess 30' of the frame 31 is provided with an internal longitudinal rib 30", projecting from one of its walls and adapted to coact on the one hand with a corresponding groove of the bearing means 30 and, on the other hand, with the securement means 32, in the form of a screw or the like (FIGS. 9 and 10). As a result of this embodiment, it is possible on the one hand to index the bearing means 30 easily as well as its mounting and, on the other hand, to obtain partial engagement, by tapping, of the screw forming the means 32 with the upper surface of the rib 30". Because of this, the connection between the lever 7 and the slat of the blind 1 is further improved.

To improve the securement of the bearing means 30 in the recess 30' of the frame 31, there can be provided, according to another characteristic of the invention, that the bearing means 30 be equipped with a complementary blocking means by anchoring in at least one side of the internal wall of the recess 30' of the frame 31.

According to one characteristic of the invention, this complementary blocking means is in the form of a sliding blocking plate 36, of a length substantially equal to half the height of the bearing means 30 and guided in a slot 37 inclined relative to the longitudinal axis of the bearing means 30, said slot extending over the half of said bearing means 30 opposite that comprising the groove coacting with the rib 30" of the recess 30' of the frame 31 and the plate being provided in its edge turned toward the middle of the bearing means 30 with a recess of small diameter (not shown) adapted to coact with an endpoint of the screw or the like forming the securement means 32. Thus, during the emplacement of the screw forming the securement means 32, this latter penetrates, by its endpoint, into the recess of the plate 36 and tends to displace this latter in the slot 37 in the direction of the corresponding wall of the recess 30'. As a result, the external edge of the plate 36 is gripping against the wall of the recess 30' and penetrates the constituent material by buttressing.

According to another modified embodiment of the invention, not shown in the accompanying drawings, the complementary blocking means could also be constituted by an independent member for elastic deformable hooking, for example with partially bent wings, deployable under traction or pressure on the support body of these wings by means of the securement means 32. By such an embodiment it is also possible to obtain a very strong connection between the frame 31 of the blind and the lever 7.

Thanks to the invention, it is possible to provide easy operation of blinds of a window having blinds, no matter what the number and size of these latter. This result is obtained by compensation of the weight of the slats of the blind by use of a prestressed resilient means 11 permitting limiting the force necessary to operate the same only to the force corresponding to the mechanical frictional forces at the joints between the different members and the bearings of the slats forming the blinds 1.

Of course, the invention is not limited to the embodiments described and shown in the accompanying drawings. Modifications remain possible, particularly as to the construction of the various elements or by substitution of technical equivalents, without thereby departing from the scope of protection of the invention.

What is claimed is:

1. In a device for operating blinds that have plural slats that are each moved pivotally with separate levers and in which each of the separate levers is attached to an axle of a respective one of the slats, the device including a centralized control means for controlling movement of the slats and actuating means for moving the slats responsive to the control means, the actuating means including a rod connecting the control means to the separate levers, the control means and the actuating means being in a casing at a side of the blinds, the improvement wherein the device comprises means for compensating for a weight of the slats during opening of the blinds, wherein the control means comprises a motor, connected by one of having the motor's output shaft engage with a pinion coacting with the rod, and having the motor's output shaft provided with one of a cam and an actuating link for a control lever of the means for compensating.

2. In a device for operating blinds that have plural slats that are each moved pivotally with separate levers and in which each of the separate levers is attached to an axle of a respective one of the slats, the device including a centralized control means for controlling movement of the slats and actuating means for moving the slats responsive to the control means, the actuating means including a rod connecting the control means to the separate levers, the control means and the actuating means being in a casing at a side of the blinds, the improvement wherein the device comprises means for compensating for a weight of the slats during opening of the blinds, wherein the control means comprises a connection device in parallel with two of the actuating means from adjacent windows with the blinds in a single casing, the connection device being in the form of one of connecting cross pieces secured the rods of each window, and directly connected to the axle of at least one of the slats.

3. In a device for operating blinds that have plural slats that are each moved pivotally with separate levers and in which each of the separate levers is attached to an axle of a respective one of the slats, the device including a centralized control means for controlling movement of the slats and actuating means for moving the slats responsive to the control means, the actuating means including a rod connecting the control means to the separate levers, the control means and the actuating means being in a casing at a side of the blinds, the improvement wherein the device comprises means for compensating for a weight of the slats during opening of the blinds, wherein the control means comprises at least two controls associated with a portion of a window having the blinds and acting independently on the slats of the corresponding blind.

4. In a device for operating blinds that have plural slats that are each moved pivotally with separate levers and in which each of the separate levers is attached to an axle of a respective one of the slats, the device including a centralized control means for controlling movement of the slats and actuating means for moving the slats responsive to the control means, the actuating means including a rod connecting the control means to the separate levers, the control means and the actuating means being in a casing at a side of the blinds, the improvement wherein the device comprises means for compensating for a weight of the slats during opening of the blinds, in which a connection of the separate levers to the axle of the respective one of the slats is effected by means of a mounting device, which comprises bearing means disposed in one end of a longitudinal recess of a frame for reception of the slat, and means for securement of each respective one of the separate levers to the corresponding bearing means, being in the form of members that are one of expansible and not expansible, mounted in corresponding ends of the frame for reception of the slat and fixed in these latter by one of cementing, force fitting, and expansion under the influence of the securement means, wherein each bearing means is provided, in prolongation of its portion entering the end of the recess, with a shoulder for bearing against the corresponding end of the frame, this shoulder being prolonged by a hollow indexing device adapted to coact with a corresponding means of the lever.

5. Device according to claim 4, wherein the hollow indexing device and the corresponding means of the lever are present respectively in the form of a hole and a channeled hub.

6. Device according to claim 4, wherein the recess of the frame is provided with an internal longitudinal rib, projecting from one of its walls and adapted to coact with a corresponding groove of the bearing means and with the securement means in a form of a screw.

7. Device according to claim 4, wherein the bearing means is provided with complementary blocking means by anchoring in at least one side of an internal wall of the recess of the frame.

8. Device according to claim 7, wherein the complementary blocking means is in a form of a sliding blocking plate, of a length substantially equal to half the height of the bearing means and guided in a slot inclined relative to a longitudinal axis of the bearing means, said slot extending over the half of said bearing means opposite that comprising a groove coacting with the rib of the recess of the frame and the plate being provided at its edge turned toward the middle of the bearing means with a recess of small diameter adapted to coact with an end point of a screw forming the securement means.

9. Device according to claim 7, wherein the complementary blocking means is constituted by an independent resiliently deformable hooking means, with bent back parallel wings, deployable under one of traction and pressure on the body of the support of these wings by means of the securement means.

10. In a device for operating blinds that have plural slats that are each moved pivotally with separate levers and in which each of the separate levers is attached to an axle of a respective one of the slats, the device including a centralized control means for controlling movement of the slats and actuating means for moving the slats responsive to the control means, the actuating means including a rod connecting the control means to the separate levers, the control means and the actuating means being in a casing at a side of the blinds, the improvement wherein the device comprises compensating means for compensating for a weight of the slats during opening of the blinds, said compensating means comprising a spring acting on an eccentric actuating plate by means of a control lever, the actuating plate being pivotally mounted in the casing and pivotally urged by the spring through the control lever, the actuating plate having a drive lug that engages a guide slot in the control lever, and wherein the control means comprises a handle acting on the control lever.

* * * * *

UNITED STATES PATENT AND TRADEMARK OFFICE

CERTIFICATE OF CORRECTION

PATENT NO. : 6,131,335

DATED : October 17, 2000

INVENTOR(S) : Roland LUTZ

It is certified that error appears in the above-indentified patent and that said Letters Patent is hereby corrected as shown below:

On the title page:

In the inventor's address, change "38100" to --68100--.

Signed and Sealed this

Eighth Day of May, 2001

*Attest:*

Nicholas P. Godici

NICHOLAS P. GODICI

*Attesting Officer*

*Acting Director of the United States Patent and Trademark Office*